US012759602B2

(12) United States Patent
Zhang et al.

(10) Patent No.: US 12,759,602 B2
(45) Date of Patent: Oct. 13, 2026

(54) TRAIN CONTROL METHOD AND SYSTEM BASED ON COMBINED COORDINATE SYSTEM, AND CONTROLLER

(71) Applicant: BYD COMPANY LIMITED, Shenzhen (CN)

(72) Inventors: Xi Zhang, Shenzhen (CN); Yedi Xiao, Shenzhen (CN); Chujun Chen, Shenzhen (CN); Weihua Liu, Shenzhen (CN)

(73) Assignee: BYD Company Limited, Shenzhen (CN)

( * ) Notice: Subject to any disclaimer, the term of this patent is extended or adjusted under 35 U.S.C. 154(b) by 5 days.

(21) Appl. No.: 18/980,912

(22) Filed: Dec. 13, 2024

(65) Prior Publication Data

US 2025/0108844 A1 Apr. 3, 2025

Related U.S. Application Data

(63) Continuation of application No. PCT/CN2023/077741, filed on Feb. 22, 2023.

(30) Foreign Application Priority Data

Jun. 29, 2022 (CN) ..... 202210750962.3

(51) Int. Cl.
*B61L 27/20* (2022.01)
*B61L 25/02* (2006.01)

(52) U.S. Cl.
CPC ..... *B61L 27/20* (2022.01); *B61L 25/025* (2013.01)

(58) Field of Classification Search
CPC ..... B61L 27/20; B61L 25/025; B61L 25/02
See application file for complete search history.

(56) References Cited

U.S. PATENT DOCUMENTS 7,653,465 B1 * 1/2010 Geiger ..... H04B 7/2606 701/19
11,400,964 B2 * 8/2022 Noffsinger ..... B61L 23/044
(Continued)

FOREIGN PATENT DOCUMENTS

CN 103738364 A 4/2014
CN 107878511 A 4/2018
(Continued)

OTHER PUBLICATIONS

International Search Report and Written Opinion for Application No. PCT/CN2023/077741, mailed on May 14, 2023, 9 pages.

*Primary Examiner* — Long T Tran
(74) *Attorney, Agent, or Firm* — Sheppard Mullin Richter & Hampton LLP

(57) ABSTRACT

A train control method, based on a combined coordinate system, includes: obtaining a target combined coordinate system corresponding to a planned train path, the target combined coordinate system comprising a plurality of basic coordinate systems with boundary logic sections, and each of the basic coordinate systems forming a physical link relationship with another basic coordinate system of the basic coordinate systems through the boundary logic sections; obtaining position information of a train located in the planned train path sent by the train, and determining preceding train information of a preceding train preceding to the train based on the position information and the physical link relationships between the basic coordinate systems; and performing a train control strategy on the train based on the preceding train information.

19 Claims, 6 Drawing Sheets

(56) References Cited

U.S. PATENT DOCUMENTS

| | | | | |
|---|---|---|---|---|
| 2012/0309293 | A1* | 12/2012 | Kummetz | H04B 7/15528 455/11.1 |
| 2014/0263862 | A1 | 9/2014 | Morris | |
| 2016/0221592 | A1* | 8/2016 | Puttagunta | B61L 27/04 |
| 2021/0261177 | A1* | 8/2021 | Lata | B61L 27/53 |
| 2022/0204061 | A1* | 6/2022 | Woo | B61L 3/10 |
| 2023/0117899 | A1* | 4/2023 | Vrba | B61L 15/0027 701/2 |
| 2023/0122132 | A1* | 4/2023 | Delp | B61L 27/16 701/120 |
| 2024/0247445 | A1* | 7/2024 | Katahira | B61B 13/00 |
| 2024/0273424 | A1* | 8/2024 | Bartek | B61L 27/53 |
| 2024/0425093 | A1* | 12/2024 | Liao | B61L 7/06 |
| 2025/0026388 | A1* | 1/2025 | Dunn | B61L 27/20 |
| 2025/0075437 | A1* | 3/2025 | Xiao | B61F 9/00 |

FOREIGN PATENT DOCUMENTS

| | | | |
|---|---|---|---|
| CN | 108163015 | A | 6/2018 |
| CN | 109383565 | A | 2/2019 |
| CN | 109484435 | A | 3/2019 |
| CN | 109383566 | B | 11/2020 |
| CN | 111874036 | A | 11/2020 |

* cited by examiner

TRAIN CONTROL METHOD AND SYSTEM BASED ON COMBINED COORDINATE SYSTEM, AND CONTROLLER

CROSS-REFERENCE TO RELATED APPLICATIONS

This application is a continuation application of International Patent Application No. PCT/CN2023/077741, filed on Feb. 22, 2023, which is based on and claims priority to and benefits of Chinese Patent Application 202210750962.3, filed on Jun. 29, 2022. The entire content of all of the above-referenced applications is incorporated herein by reference.

FIELD

The present disclosure relates to the field of train technologies, and more particularly, to a train control method and system based on a combined coordinate system, and a controller.

BACKGROUND

Currently, before each cyclic operation of a train control system (for example, an automatic train supervision (ATS) system), each of logic sections in a line corresponding to the system is divided into multiple independent coordinate systems based on a position of a turnout in the line. In the above solution, if a turnout is included in the logic section of each independent coordinate system, a position of the turnout needs to be fixed in the independent coordinate system. The position of the turnout may change during each cyclic operation of the system. Therefore, at the beginning of each cyclic operation, an independent coordinate system is re-established based on a current position of the turnout, which wastes cycle time of an application. In addition, in the related art, coordinate values of a communication vehicle in an independent coordinate system need to be calculated first, then coordinate values of a non-communication vehicle in the independent coordinate system are calculated, all train position information is ranked based on all of the above coordinate values, and then a preceding train and a rear train of a train are determined based on a ranking result.

In the above solution, the position of the turnout in the independent coordinate system is fixed, and only current coordinate values of each train in the independent coordinate system are considered during the ranking without considering a requirement of autonomous route planning for the train during traveling. In other words, during the autonomous route planning of the train, the position of the turnout in the line may change. However, in the above solution in the related art, the independent coordinate system corresponding to the position of the turnout cannot be automatically updated based on a change in an autonomously planned route. In this way, a finally obtained train ranking result is inaccurate.

SUMMARY

Embodiments of the present disclosure provide a train control method and system based on a combined coordinate system and a controller, so as to resolve a problem such as an inaccurate train ranking result in the related art.

A train control method based on a combined coordinate system is provided. The train control method includes the following steps.

A target combined coordinate system corresponding to a planned train path is obtained. The target combined coordinate system includes multiple basic coordinate systems with boundary logic sections. Each of the basic coordinate systems forms a physical link relationship with another basic coordinate system of the basic coordinate systems through the boundary logic sections.

Position information of a train located in the planned train path sent by the train is obtained. Preceding train information of the preceding train preceding to the train is determined based on the position information and the physical link relationship between the basic coordinate systems.

A train control strategy is performed on the train based on the preceding train information.

A controller is provided. The controller is configured to perform the above train control method based on a combined coordinate system.

A train control system is provided. The train control system includes a controller connected to a vehicle on-board controller (VOBC) of a train. The controller is configured to perform the above train control method based on a combined coordinate system.

In the train control method and system based on a combined coordinate system, and the controller provided in the present disclosure, the method includes the following steps. The target combined coordinate system corresponding to the planned train path is obtained. The target combined coordinate system includes the multiple basic coordinate systems with the boundary logic sections. Each of the basic coordinate systems forms the physical link relationship with another basic coordinate system of the basic coordinate systems through the boundary logic section. The position information of a train located in the planned train path sent by the train is obtained. The preceding train information of the preceding train preceding to the train is determined based on the position information and the physical link relationship between the basic coordinate systems. The train control strategy is performed on the train based on the preceding train information.

In the present disclosure, the preceding train information of all trains in the planned train path may be accurately determined based on the physical link relationships between the basic coordinate systems in the target combined coordinate system and the position information of all of the trains in the train control system, then the train control strategy may be performed on the train based on the preceding train information, and a preset traveling route of the train may be autonomously planned based on the preceding train information, to improve efficiency of autonomous planning of a traveling route by the train.

BRIEF DESCRIPTION OF THE DRAWINGS

To describe technical solutions of embodiments of the present disclosure more clearly, accompanying drawings required for describing the embodiments of the present disclosure are briefly described below. Apparently, the accompanying drawings in the following description merely show some embodiments of the present disclosure, and a person of ordinary skill in the art may still derive other accompanying drawings from the accompanying drawings without creative efforts.

DETAILED DESCRIPTION

The technical solutions in embodiments of the present disclosure are to be described clearly and completely with reference to the accompanying drawings in the embodiments of the present disclosure. Apparently, the described embodiments are some rather than all of the embodiments of the present disclosure. All other embodiments obtained by a person of ordinary skill in the art based on the embodiments of the present disclosure without creative efforts shall fall within the protection scope of the present disclosure.

Figure 1:
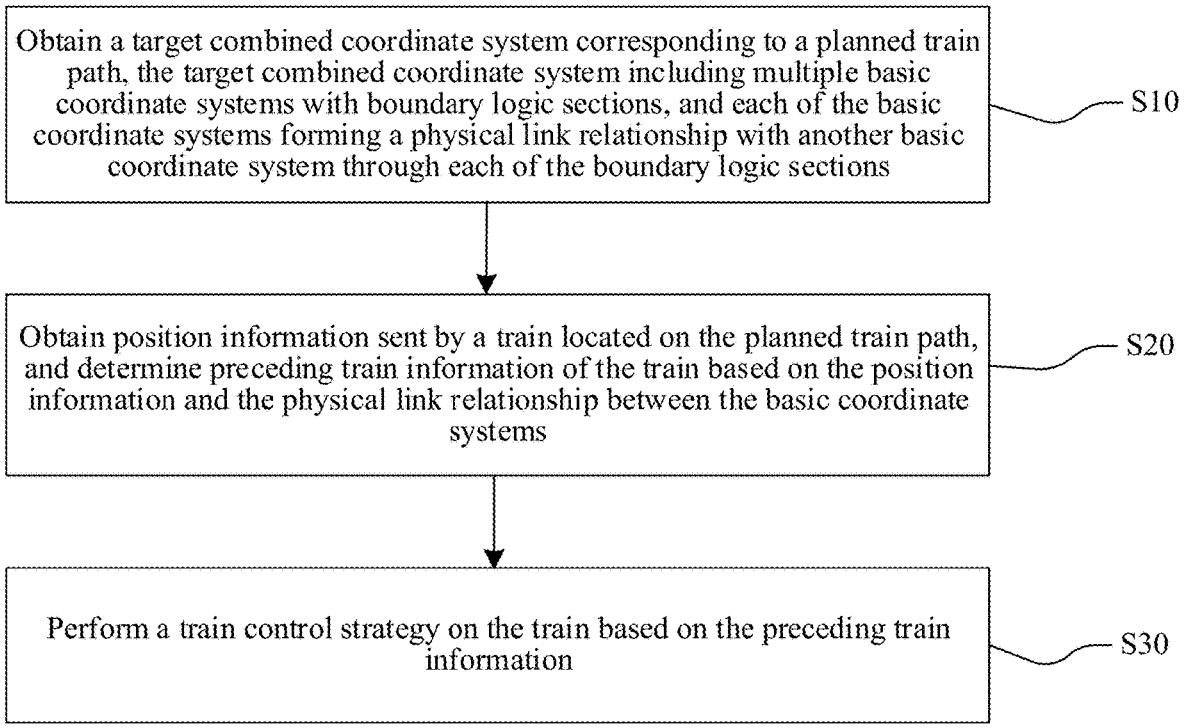
FIG. 1 is a flowchart of a train control method based on a combined coordinate system according to an embodiment of the present disclosure.

In an embodiment, as shown in FIG. 1, a train control method based on a combined coordinate system includes the following steps S10-S30.

S10: A target combined coordinate system corresponding to a planned train path is obtained. The target combined coordinate system includes multiple basic coordinate systems with boundary logic sections. Each of the basic coordinate systems forms a physical link relationship with another basic coordinate system of the basic coordinate systems through the boundary logic sections. In other words, in this embodiment, the target combined coordinate system is first constructed at a first start of and before a cyclic operation of a train control system (for example, an automatic train supervision (ATS) system). It may be understood that the target combined coordinate system includes an upward combined coordinate system and a downward combined coordinate system. The upward combined coordinate system includes all basic coordinate systems in an upward direction of the planned train path (all of the basic coordinate systems in the upward direction is associated with the upward direction). The downward combined coordinate system includes all basic coordinate systems in a downward direction of the planned train path (all of the basic coordinate systems in the downward direction is associated with the downward direction). Each of the boundary logic sections in the basic coordinate system includes a bulb line logic section, a turnout including logic section, or a terminal logic section in all logic sections in the planned train path. It may be understood that each basic coordinate system may further include an ordinary logic section. The ordinary logic section is another logic section in all of the logic sections in the planned train path other than the boundary logic sections. In other words, in each basic coordinate system, other than a first logic section and a last logic section, another logic section is the terminal logic section that does not include the turnout, does not have a bulb line attribute (which is not the bulb line logic section), and is not located at an end of the path. In addition, in the same basic coordinate system, each of the logic sections needs to be linked based on a traveling direction corresponding to the logic section. In an embodiment, all logic sections in a basic coordinate system in the upward direction are linked in sequence based on an upward link relationship of the planned train path. All logic sections in a basic coordinate system in the downward direction are linked in sequence based on a downward link relationship of the planned train path. The physical link relationship between the basic coordinate systems is constructed/formed based on the upward link relationship and the downward link relationship corresponding to the planned train paths corresponding to the boundary logic sections of each basic coordinate system.

In the present disclosure, the logic sections and the basic coordinate systems are linked based on the link relationship (including the upward link relationship and the downward link relationship) of the planned train path. In an embodiment, a logic section in the planned train path cannot be skipped to perform interval linking, nor can another logic section be inserted into the determined link relationship in the planned train path. Each logic section in the planned train path exists in the basic coordinate system. A logic section having the upward direction or the downward direction is not allowed to exist in two basic coordinate systems having the same traveling direction at the same time. In this way, the target combined coordinate system and each basic coordinate system thereof have uniqueness, and the preceding train information may be subsequently determined easily based on the target combined coordinate system.

Figure 7:
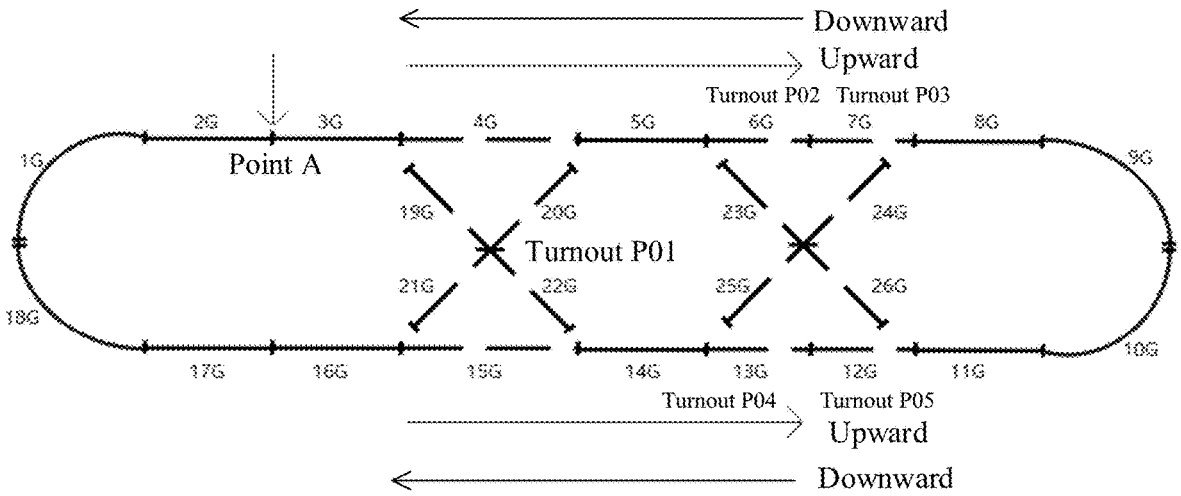
FIG. 7 is a schematic diagram of a planned train path including a single turnout, multiple double crossovers, and a bulb line according to an embodiment of the present disclosure.

It may be understood that each upward coordinate system includes at least one boundary logic section. In the present disclosure, if the basic coordinate system includes the ordinary logic section, the boundary logic section may be located at either end of the ordinary logic section as an initial boundary logic section or/and a terminal boundary logic section. However, each basic coordinate system may also have only one or two boundary logic sections and does not include the ordinary logic section. When only one boundary logic section exists in the basic coordinate system, the boundary logic section is both the initial boundary logic section and the terminal boundary logic section. When only two boundary logic sections linked to each other exist in the basic coordinate system, the two boundary logic sections are respectively the initial boundary logic section and the terminal boundary logic section. Further, a physical connection point between two logic sections in a basic coordinate system which have both a forward link relationship and a backward link relationship may be recorded as a common boundary line (for example, a point A in FIG. 7 is a common boundary line of logic sections 2G and 3G). The common boundary line cannot be a bulb line. When a turnout exists in the basic coordinate system, the turnout including logic section can be only the boundary logic section. Therefore, if a turnout exists in the initial boundary logic section of the basic coordinate system, a serial number of a corresponding initial turnout and an expected position of the initial turnout need to be recorded in initial turnout information of the basic coordinate system. If a turnout exists in the terminal boundary logic section of the basic coordinate system, a serial number of a corresponding terminal turnout and an expected position of the terminal turnout are recorded in terminal turnout information of the basic coordinate system, to facilitate subsequent determining of a physical link relationship between the boundary logic section where the turnout is located and a next (or multiple) basic coordinate system(s). The above expected position of the turnout means that a current position of the turnout may link at least two different logic sections. When the turnout is in the above expected position of the turnout, a train may travel within the logic sections linked to each other through the turnout. When the turnout is not in the above expected position of the turnout, a fault zone exists between the logic sections corresponding to the turnout position. In this case, the train cannot travel within the logic section corresponding to the position.

A link relationship of all ordinary logic sections in each basic coordinate system is unique. In other words, the ordinary logic section cannot include the turnout. A turnout included in the boundary logic section cannot be located between the ordinary logic section and the boundary logic section, but should be located at an end of the boundary logic section away from the ordinary logic section. In an embodiment, a turnout tip cannot be seen from a perspective of any ordinary logic section inside the basic coordinate system toward the boundary logic section. It may be understood that the basic coordinate systems in the upward combined coordinate system and in the downward combined coordinate system described above are numbered separately, and each basic coordinate system and a corresponding traveling direction and a corresponding serial number are associatively stored in the upward combined coordinate system or the downward combined coordinate system.

Figure 2:
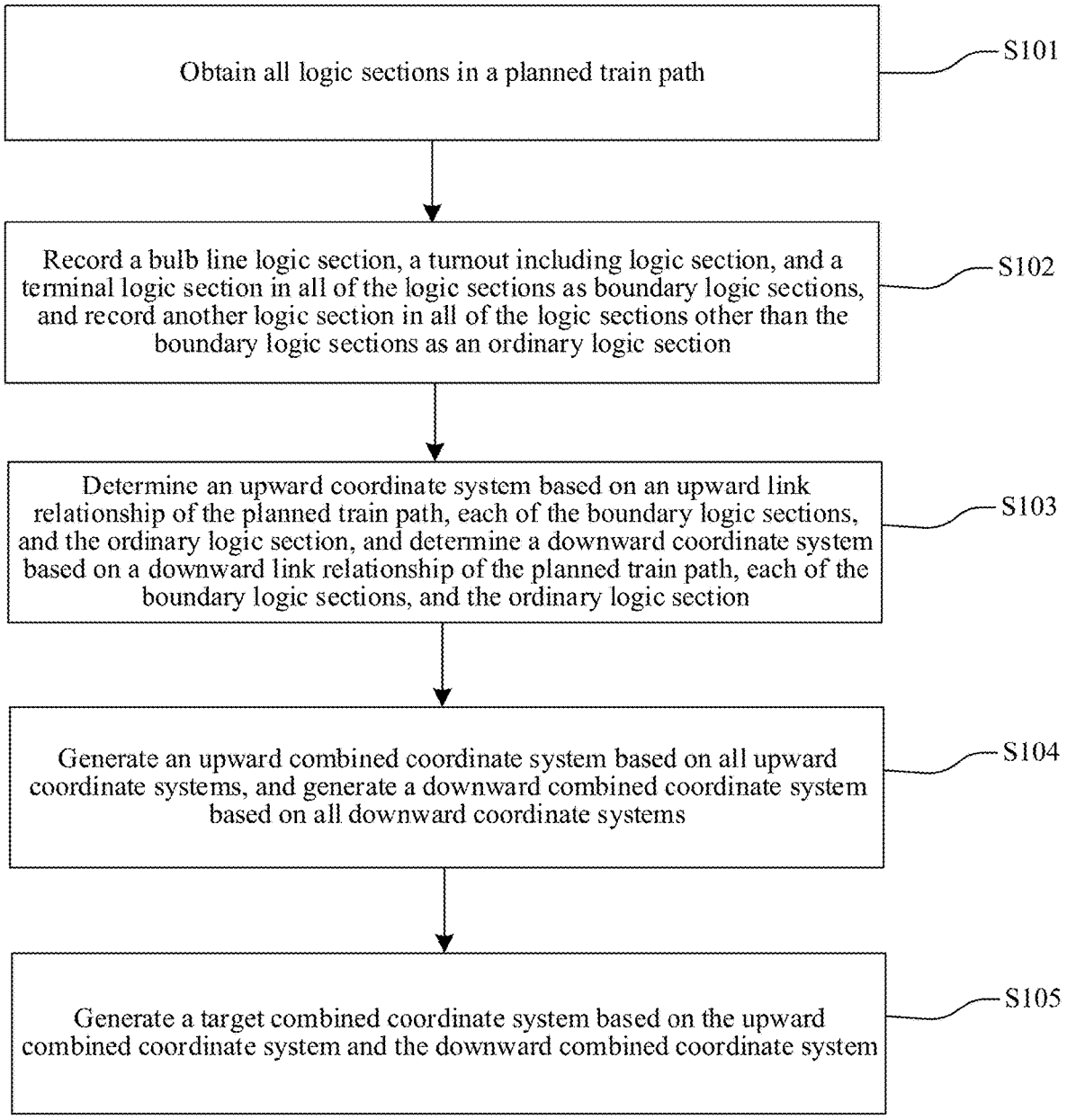
FIG. 2 is a flowchart of step S10 of a train control method based on a combined coordinate system according to an embodiment of the present disclosure.

In an embodiment, the basic coordinate system includes the upward coordinate system and the downward coordinate system. Further, as shown in FIG. 2, before step S10, that is, before the obtaining the target combined coordinate system corresponding to the planned train path, the method further includes the following steps S101-S105.

S101: All logic sections in the planned train path are obtained. In other words, the planned train path may be divided into multiple logic sections as required. In the present disclosure, a same logic section belongs to two different basic coordinate systems when correspondingly associated with the upward direction and the downward direction. In all basic coordinate systems corresponding to a same traveling direction (the upward direction or the downward direction), each logic section exists only in one of the basic coordinate systems. In other words, each logic section in the planned train path exists in the basic coordinate system, and a logic section having the upward direction or the downward direction is not allowed to exist in two basic coordinate systems with the same traveling direction at the same time.

S102: A bulb line logic section, a turnout including logic section, and a terminal logic section in all of the logic sections are recorded as the boundary logic sections. Another logic section in all of the logic sections other than the boundary logic sections is recorded as an ordinary logic section. In other words, the boundary logic sections in the basic coordinate system are the bulb line logic section, the turnout including logic section, and the terminal logic section of all of the logic sections in the planned train path. It may be understood that each basic coordinate system may further include an ordinary logic section. The ordinary logic section is another logic section in all of the logic sections in the planned train path other than the boundary logic sections. In other words, in each basic coordinate system, other than a first logic section and a last logic section, another logic section is the terminal logic section that does not include the turnout, does not have a bulb line attribute (which is not the bulb line logic section), and is not located at an end of the path.

S103: The upward coordinate system is determined based on an upward link relationship of the planned train path, each of the boundary logic sections, and the ordinary logic section. The downward coordinate system is determined based on a downward link relationship of the planned train path, each of boundary logic sections, and the ordinary logic section. In the same basic coordinate system, each of the logic sections needs to be linked based on a traveling direction correspondingly associated with the logic section. In other words, all logic sections in the basic coordinate system (that is, the upward coordinate system) in the upward direction are linked in sequence based on the upward link relationship of the planned train path. All logic sections in the basic coordinate system (that is, the downward coordinate system) in the downward direction are linked in sequence based on the downward link relationship of the planned train path. In this embodiment, the logic sections are linked based on the link relationship (including the upward link relationship and the downward link relationship) of the planned train path. In this way, each basic coordinate system has definite uniqueness, and the preceding train information may be subsequently determined easily based on the basic coordinate system.

In an embodiment, in step S103, the determining the upward coordinate system based on an upward link relationship of the planned train path, each of the boundary logic sections, and the ordinary logic section includes the following step. The upward coordinate system is determined based on the following upward coordinate system generation requirements. The upward coordinate system generation requirements are set as required. In this embodiment, the upward coordinate system generation requirements include but are not limited to the following requirements.

(1) All logic sections in each upward coordinate system are connected in sequence based on the upward link relationship. In other words, all logic sections in the basic coordinate system (that is, the upward coordinate system) in the upward direction are linked in sequence based on the upward link relationship of the planned train path.

(2) Each upward coordinate system includes at least one boundary logic section. In other words, if the upward coordinate system includes the ordinary logic section, the boundary logic section needs to be located at either end of the ordinary logic section as the initial boundary logic section or/and the terminal boundary logic section. However, each upward coordinate system may also have only one or two boundary logic sections and does not include the ordinary logic section. When only one boundary logic section exists in the upward coordinate system, the boundary logic section exists as both the initial boundary logic section and the terminal boundary logic section. When only two boundary logic sections linked to each other exist in the upward coordinate system, the two boundary logic sections exist respectively as the initial boundary logic section and the terminal boundary logic section.

(3) The ordinary logic section in each upward coordinate system needs to be located between the two boundary logic sections. In other words, if the basic coordinate system includes the ordinary logic section, the basic coordinate system needs to include both the boundary logic sections, and the ordinary logic section needs to be located between the initial boundary logic section and the terminal boundary logic section.

(4) An upward link relationship of all ordinary logic sections in each upward coordinate system is unique. It may be understood that, in each upward coordinate system, the ordinary logic section cannot include the turnout. A turnout included in the boundary logic section cannot be located between the ordinary logic section and the boundary logic section, but should be located at an end of the boundary logic section away from the ordinary logic section. In an embodiment, a turnout tip cannot be seen from a perspective of any ordinary logic section inside the upward coordinate system toward the boundary logic section.

In an embodiment, in step S103, the determining the downward coordinate system based on a downward link relationship of the planned train path, each of the boundary logic sections, and the ordinary logic section includes the following step. The downward coordinate system is determined based on the following downward coordinate system generation requirements. The downward coordinate system generation requirements are set as required. In an embodiment, the logic sections in each upward coordinate system of the upward combined coordinate system corresponding to the planned train path may be arranged/disposed in a reverse order (the traveling directions are opposite and the logic sections are the same). In this way, all the downward coordinate systems can be formed. In this embodiment, the downward coordinate system generation requirements include but are not limited to the following requirements.

(1) All logic sections in each downward coordinate system are connected in sequence based on the downward link relationship. In other words, all logic sections in the basic coordinate system (that is, the downward coordinate system) in the downward direction are linked in sequence based on the downward link relationship of the planned train path.

(2) Each downward coordinate system includes at least one boundary logic section. In other words, if the downward coordinate system includes the ordinary logic section, the boundary logic section needs to be located at either end of the ordinary logic section as the initial boundary logic section or/and the terminal boundary logic section. However, each downward coordinate system may also have only one or two boundary logic sections and does not include the ordinary logic section. When only one boundary logic section exists in the downward coordinate system, the boundary logic section exists as both the initial boundary logic section and the terminal boundary logic section. When only two boundary logic sections linked to each other exist in the downward coordinate system, the two boundary logic sections exist respectively as the initial boundary logic section and the terminal boundary logic section.

(3) The ordinary logic section in each downward coordinate system needs to be located between the two boundary logic sections. In other words, if the downward coordinate system includes the ordinary logic section, the downward coordinate system needs to include both the boundary logic sections, and the ordinary logic section needs to be located between the initial boundary logic section and the terminal boundary logic section.

(4) A downward link relationship of all ordinary logic sections in each downward coordinate system is unique. It may be understood that, in each downward coordinate system, the ordinary logic section cannot include the turnout. A turnout included in the boundary logic section cannot be located between the ordinary logic section and the boundary logic section, but should be located at an end of the boundary logic section away from the ordinary logic section. In an embodiment, a turnout tip cannot be seen from a perspective of any ordinary logic section inside the downward coordinate system toward the boundary logic section.

S104: An upward combined coordinate system is generated based on all upward coordinate systems. A downward combined coordinate system is generated based on all downward coordinate systems. In other words, the upward combined coordinate system is a set of all upward coordinate systems, and the downward combined coordinate system is a set of all downward coordinate systems. It may be understood that the basic coordinate systems (including the upward coordinate system and the downward coordinate system) in the upward combined coordinate system and in the downward combined coordinate system described above are numbered separately, and each basic coordinate system and a corresponding traveling direction and a corresponding serial number are associatively stored in the upward combined coordinate system or the downward combined coordinate system.

In an embodiment, the boundary logic section includes the initial boundary logic section and the terminal boundary logic section. The physical link relationship includes an upward physical link relationship. Further, in step S104, the generating an upward combined coordinate system based on all upward coordinate systems includes the following step.

An upward initial link coordinate system and an upward terminal link coordinate system of each upward coordinate system are obtained based on the upward link relationship of the planned train path. The upward initial link coordinate system refers to a previous basic coordinate system of the initial boundary logic section of the upward coordinate system in an upward direction, and the upward terminal link coordinate system refers to a next basic coordinate system of the terminal boundary logic section of the upward coordinate system in the upward direction. In other words, in the step, a controller of the train control system may search for a next basic coordinate system physically linked with each of the upward coordinate systems in the upward direction for the upward coordinate system. A process includes the following steps. First, a next logic section (multiple next logic sections may be provided) physically linked with the terminal boundary logic section of the upward coordinate system in the upward direction is searched for based on the upward link relationship. Then a basic coordinate system in which the next logic section is used as the initial boundary logic section is searched for (in the process, each of the basic coordinate systems needs to be searched for in the upward combined coordinate system and the downward combined coordinate system, because during searching in the traveling direction, if the bulb line logic section is skipped, the traveling direction needs to be changed, and a traveling direction for the search changes accordingly). Finally, the basic coordinate system that is found is determined as the upward terminal link coordinate system.

In the step, the controller of the train control system may further search for a previous basic coordinate system physically linked with each of the upward coordinate systems in the upward direction for the upward coordinate system. A process includes the following steps. First, a previous logic section (multiple previous logic sections may be provided) physically linked with the initial boundary logic section of the upward coordinate system in the upward direction is searched for based on the upward link relationship. Then a basic coordinate system in which the previous logic section is used as the terminal boundary logic section is searched for (in the process, each of the basic coordinate systems needs to be searched for in the upward combined coordinate system and the downward combined coordinate system, because during searching in the traveling direction, if the bulb line logic section is skipped, the traveling direction needs to be changed, and a traveling direction for the search changes accordingly). Finally, the basic coordinate system that is found is determined as the upward initial link coordinate system.

The upward initial link coordinate system and the upward terminal link coordinate system are recorded as the upward physical link relationship of the upward coordinate system corresponding to the upward initial link coordinate system and the upward terminal link coordinate system. The upward combined coordinate system is generated based on all upward coordinate systems and the upward physical link relationship corresponding to all of the upward coordinate systems. In other words, the upward coordinate system that is used as a to-be-searched object, the upward terminal link coordinate system that is found and related information thereof (for example, a traveling direction and a serial number corresponding to the upward terminal link coordinate system), and the upward initial link coordinate system that is found and related information thereof (for example, a traveling direction and a serial number corresponding to the upward terminal link coordinate system) are associatively stored. Then the upward physical link relationship of the upward coordinate system is generated. In addition, the upward combined coordinate system may be generated based on each of the upward coordinate systems and the upward physical link relationship corresponding to the upward coordinate systems.

In an embodiment, the boundary logic section includes the initial boundary logic section and the terminal boundary logic section. The physical link relationship includes a downward physical link relationship. Further, in step S104, the generating a downward combined coordinate system based on all downward coordinate systems includes the following step.

A downward initial link coordinate system and a downward terminal link coordinate system of each downward coordinate system are obtained based on the downward link relationship of the planned train path. The downward initial link coordinate system refers to a previous basic coordinate system of the initial boundary logic section of the downward coordinate system in a downward direction, and the downward terminal link coordinate system refers to a next basic coordinate system of the terminal boundary logic section of the downward coordinate system in the downward direction. In other words, in the step, a controller of the train control system may search for a next basic coordinate system physically linked with each of the downward coordinate systems in the downward direction for the downward coordinate system. A process includes the following steps. First, a next logic section (multiple next logic sections may be provided) physically linked with the terminal boundary logic section of the downward coordinate system in the downward direction is searched for based on the downward link relationship. Then a basic coordinate system in which the next logic section is used as the initial boundary logic section is searched for (in the process, each of the basic coordinate systems needs to be searched for in the upward combined coordinate system and the downward combined coordinate system, because during searching in the traveling direction, if the bulb line logic section is skipped, the traveling direction needs to be changed, and a traveling direction for the search changes accordingly). Finally, the basic coordinate system that is found is determined as the downward terminal link coordinate system.

In the step, the controller of the train control system may further search for a previous basic coordinate system physically linked with each of the downward coordinate systems in the downward direction for the downward coordinate system. A process includes the following steps. First, a previous logic section (multiple previous logic sections may be provided) physically linked with the initial boundary logic section of the downward coordinate system in the downward direction is searched for based on the downward link relationship. Then a basic coordinate system in which the previous logic section is used as the terminal boundary logic section is searched for (in the process, each of the basic coordinate systems needs to be searched for in the upward combined coordinate system and the downward combined coordinate system, because during searching in the traveling direction, if the bulb line logic section is skipped, the traveling direction needs to be changed, and a traveling direction for the search changes accordingly). Finally, the basic coordinate system that is found is determined as the downward initial link coordinate system.

The downward initial link coordinate system and the downward terminal link coordinate system are recorded as the downward physical link relationship of the downward coordinate system corresponding to the downward initial link coordinate system and the downward terminal link coordinate system. The downward combined coordinate system is generated based on all downward coordinate systems and the downward physical link relationship corresponding to all of the downward coordinate systems. In other words, the downward coordinate system that is used as a to-be-searched object, the downward terminal link coordinate system that is found and related information thereof (for example, a traveling direction and a serial number corresponding to the downward terminal link coordinate system), and the downward initial link coordinate system that is found and related information thereof (for example, a traveling direction and a serial number corresponding to the downward terminal link coordinate system) are associatively stored. Then the downward physical link relationship of the downward coordinate system is generated. In addition, the downward combined coordinate system may be generated based on all downward coordinate systems and the downward physical link relationship corresponding to all of the downward coordinate systems.

S105: The target combined coordinate system is generated based on the upward combined coordinate system and the downward combined coordinate system. In other words, the target combined coordinate system is a set of basic coordinate systems classified as the upward combined coordinate system and the downward combined coordinate system.

Figure 5:
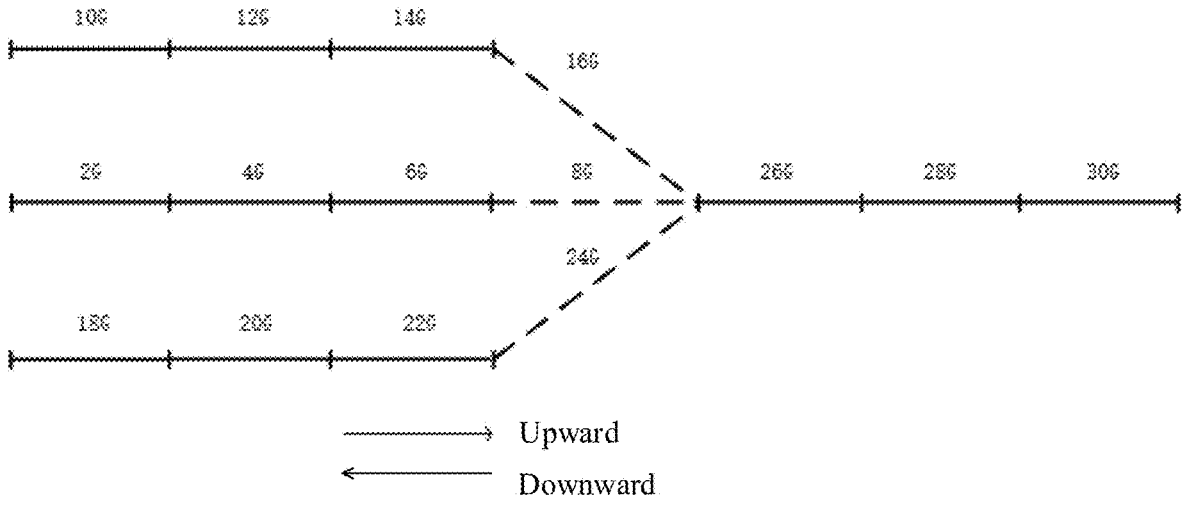
FIG. 5 is a schematic diagram of a planned train path including three turnouts according to an embodiment of the present disclosure.
Figure 6:
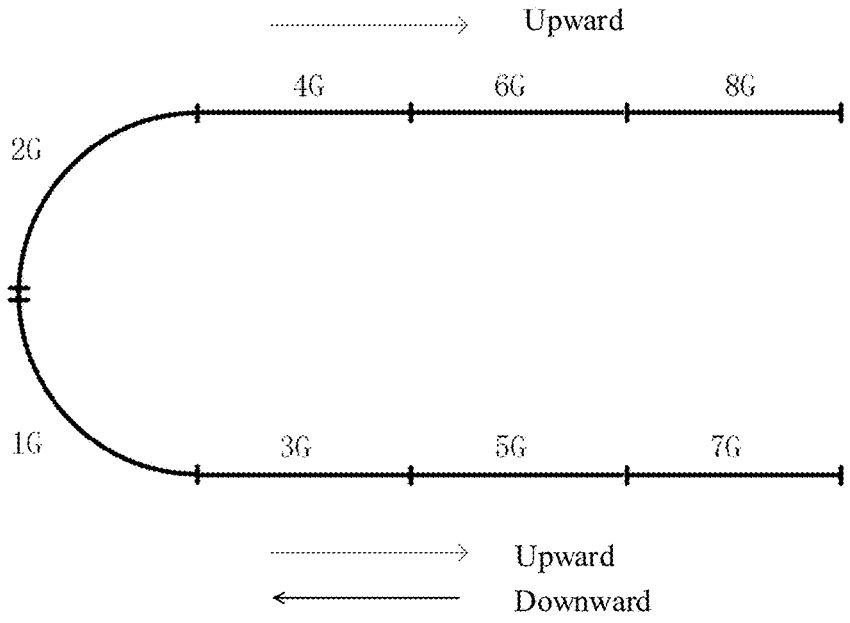
FIG. 6 is a schematic diagram of a planned train path including a bulb line according to an embodiment of the present disclosure.

Based on the above, the basic coordinate system, the target combined coordinate system, and the above physical link relationship (each G in FIG. 5, FIG. 6, and FIG. 7 represents the logic section, for example, 10G represents a $10^{th}$ logic section in the planned train path shown in the figure) are described by using FIG. 5, FIG. 6, and FIG. 7.

As shown in FIG. 5, 8G, 16G, and 24G in FIG. 5 are each a turnout including logic section. 12G, 14G, 4G, 6G, 20G, 22G, 26G, and 28G are each an ordinary logic section. 10G, 2G, 18G, and 30G are each a terminal logic section. An upward combined coordinate system is established based on an upward direction of a planned train path shown in FIG. 6, including the following upward coordinate systems:

an upward coordinate system 0: 10G, 12G, 14G, 16G;

an upward coordinate system 1: 2G, 4G, 6G, 8G;

an upward coordinate system 2: 18G, 20G, 22G, 24G; and an upward coordinate system 3: 26G, 28G, 30G.

A downward combined coordinate system is established based on a downward direction of a planned train path shown in FIG. 5, including the following downward coordinate systems:

a downward coordinate system 0: 30G, 28G, 26G;

a downward coordinate system 1: 16G, 14G, 12G, 10G;

a downward coordinate system 2: 8G, 6G, 4G, 2G; and a downward coordinate system 3: 24G, 22G, 20G, 18G.

The physical link relationships among all basic coordinate systems in the planned train path include the following:

the upward coordinate system 0 (without a previous basic coordinate system) ---> the upward coordinate system 3;

the upward coordinate system 1 (without a previous basic coordinate system) ---> the upward coordinate system 3;

the upward coordinate system 2 (without a previous basic coordinate system) ---> the upward coordinate system 3;

the downward coordinate system 0 (without a previous basic coordinate system) --->the downward coordinate system 1, the downward coordinate system 2, and the downward coordinate system 3.

As shown in FIG. 6, a joint of 1G and 2G shown in FIG. 6 is a bulb line. An upward combined coordinate system is established based on an upward direction of a planned train path shown in FIG. 7, including the following upward coordinate systems:

an upward coordinate system 0: 2G, 4G, 6G, 8G; and an upward coordinate system 1: 1G, 3G, 5G, 7G.

A downward combined coordinate system is established based on a downward direction of a planned train path shown in FIG. 7, including the following downward coordinate systems:

a downward coordinate system 0: 8G, 6G, 4G, 2G; and a downward coordinate system 1: 7G, 5G, 3G, 1G.

The physical link relationships among all basic coordinate systems in the planned train path include the following:

the downward coordinate system 0 (without a previous basic coordinate system) --->the upward coordinate system 1; and the downward coordinate system 1 (without a previous basic coordinate system) --->the upward coordinate system 0.

As shown in FIG. 7, 4G, 19G, 20G, 21G, 22G, and 15G shown in FIG. 7 are each a logic section including a turnout P01. 6G and 23G are each a logic section including a turnout P02. 7G and 24G are each a logic section including a turnout P03. 13G and 25G are each a logic section including a turnout P04. 12G and 26G are each a logic section including a turnout P05. A joint of 1G and 18G is a bulb line. A joint of 9G and 10G is a bulb line.

Figure 8:
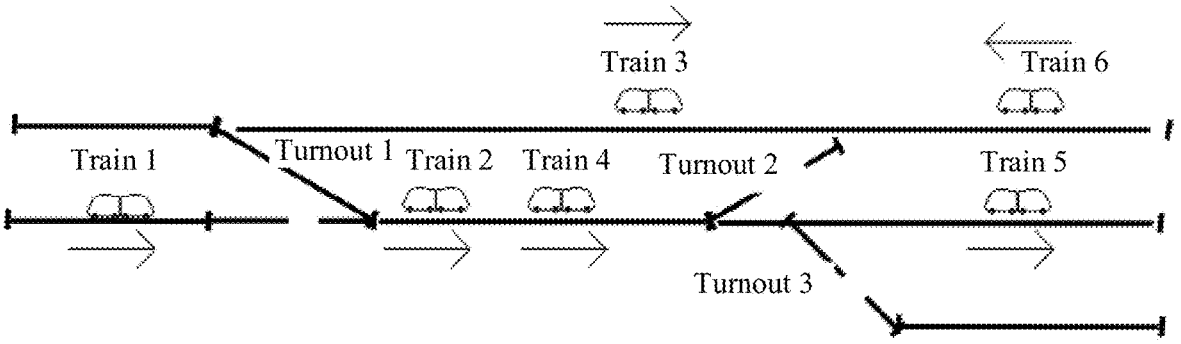
FIG. 8 is a schematic diagram of a train traveling in a planned train path according to an embodiment of the present disclosure.

An upward combined coordinate system is established based on an upward direction of a planned train path shown in FIG. 8, including the following upward coordinate systems and physical link relationships thereof:

an upward coordinate system 0: 1G, 2G, 3G, with a previous basic coordinate system in the upward direction being a downward coordinate system 5, and next basic coordinate systems in the upward direction being an upward coordinate system 1 and an upward coordinate system 10;

the upward coordinate system 1: 4G, with a previous basic coordinate system in the upward direction being the upward coordinate system 0, and a next basic coordinate system in the upward direction being an upward coordinate system 2;

the upward coordinate system 2: 5G, with previous basic coordinate systems in the upward direction being the upward coordinate system 1 and an upward coordinate system 11, and next basic coordinate systems in the upward direction being an upward coordinate system 3 and an upward coordinate system 12;

the upward coordinate system 3: 6G, 7G, with a previous basic coordinate system in the upward direction being the upward coordinate system 2, and a next basic coordinate system in the upward direction being an upward coordinate system 4;

the upward coordinate system 4: 8G, 9G, with previous basic coordinate systems in the upward direction being the upward coordinate system 3 and an upward coordinate system 13, and a next basic coordinate system in the upward direction being a downward coordinate system 9;

an upward coordinate system 5: 18G, 17G, 16G, with a previous basic coordinate system in the upward direction being a downward coordinate system 0, and next basic coordinate systems in the upward direction being an upward coordinate system 6 and an upward coordinate system 11;

the upward coordinate system 6: 15G, with a previous basic coordinate system in the upward direction being the upward coordinate system 5, and a next basic coordinate system in the upward direction being an upward coordinate system 7;

the upward coordinate system 7: 14G, with a previous basic coordinate system in the upward direction being an upward coordinate system 15, and next basic coordinate systems in the upward direction being an upward coordinate system 8 and the upward coordinate system 13;

the upward coordinate system 8: 13G, 12G, with a previous basic coordinate system in the upward direction being the upward coordinate system 7, and a next basic coordinate system in the upward direction being an upward coordinate system 9;

the upward coordinate system 9: 11G, 10G, with previous basic coordinate systems in the upward direction being the upward coordinate system 8 and an upward coordinate system 12, and a next basic coordinate system in the upward direction being a downward coordinate system 4;

the upward coordinate system 10: 19G, 22G, with a previous basic coordinate system in the upward direction being the upward coordinate system 0, and a next basic coordinate system in the upward direction being the upward coordinate system 7;

the upward coordinate system 11: 21G, 20G, with a previous basic coordinate system in the upward direction being the upward coordinate system 5, and a next basic coordinate system in the upward direction being the upward coordinate system 2;

the upward coordinate system 12: 23G, 26G, with a previous basic coordinate system in the upward direction being the upward coordinate system 2, and a next basic coordinate system in the upward direction being the upward coordinate system 9; and the upward coordinate system 13: 25G, 24G, with a next basic coordinate system in the upward direction being the upward coordinate system 4, and a previous basic coordinate system in the upward direction being the upward coordinate system 7.

An upward combined coordinate system is established based on a downward direction of the planned train path shown in FIG. 8, including the following downward coordinate systems and the physical link relationships thereof:

a downward coordinate system 0: 3G, 2G, 1G, with previous basic coordinate systems in the downward direction being a downward coordinate system 1 and a downward coordinate system 10, and a next basic coordinate system in the downward direction being the upward coordinate system 5;

the downward coordinate system 1: 4G, with a previous basic coordinate system in the downward direction being a downward coordinate system 2, and a next basic coordinate system in the downward direction being the downward coordinate system 0;

the downward coordinate system 2: 5G, with previous basic coordinate systems in the downward direction being a downward coordinate system 3 and a downward coordinate system 12, and next basic coordinate systems in the downward direction being the downward coordinate system 1 and a downward coordinate system 11;

the downward coordinate system 3: 7G, 6G, with a previous basic coordinate system in the downward direction being a downward coordinate system 4, and a next basic coordinate system in the downward direction being the downward coordinate system 2;

the downward coordinate system 4: 9G, 8G, with a previous basic coordinate system in the downward direction being the upward coordinate system 9, and next basic coordinate systems in the downward direction being the downward coordinate system 3 and a downward coordinate system 13;

a downward coordinate system 5: 16G, 17G, 18G, with previous basic coordinate systems in the downward direction being a downward coordinate system 6 and the downward coordinate system 11, and a next basic coordinate system in the downward direction being the upward coordinate system 0;

the downward coordinate system 6: 15G, with a previous basic coordinate system in the downward direction being a downward coordinate system 7, and a next basic coordinate system in the downward direction being the downward coordinate system 5;

the downward coordinate system 7: 14G, with previous basic coordinate systems in the downward direction being a downward coordinate system 8 and a downward coordinate system 13, and next basic coordinate systems in the downward direction being the downward coordinate system 6 and a downward coordinate system 10;

the downward coordinate system 8: 12G, 13G, with a previous basic coordinate system in the downward direction being a downward coordinate system 9, and a next basic coordinate system in the downward direction being the downward coordinate system 7;

the downward coordinate system 9: 10G, 11G, with a previous basic coordinate system in the downward direction being the upward coordinate system 4, and next basic coordinate systems in the downward direction being the downward coordinate system 8 and the downward coordinate system 12;

the downward coordinate system 10: 22G, 19G, with a previous basic coordinate system in the downward direction being the downward coordinate system 7, and a next basic coordinate system in the downward direction being the downward coordinate system 0;

the downward coordinate system 11: 20G, 21G, with a previous basic coordinate system in the downward direction being the downward coordinate system 5, and a next basic coordinate system in the downward direction being the downward coordinate system 5;

the downward coordinate system 12: 26G, 23G, with a previous basic coordinate system in the downward direction being the downward coordinate system 9, and a next basic coordinate system in the downward direction being the downward coordinate system 2;

the downward coordinate system 13: 24G, 25G, with a previous basic coordinate system in the downward direction being the downward coordinate system 4, and a next basic coordinate system in the downward direction being the downward coordinate system 7.

S20: Position information of the train sent by the train located in the planned train path is obtained. Preceding train information of a preceding train preceding the train is determined based on the position information and the physical link relationship between the basic coordinate systems. It should be noted that the above step S10 in this embodiment is performed before a first start of a cyclic operation of the train control system associated with the planned train path, and step S20 is performed after the first start of cyclic operation of the train control system associated with the planned train path.

In an embodiment, in step S20, the obtaining position information sent by a train located in the planned train path includes the following step.

Position information of each train sent by each of the trains located in the planned train path through a vehicle on-board controller (VOBC) is obtained. In an embodiment, the position information includes but is not limited to the following information: a first logic section of a maximum safe front end of the train in the planned train path, a first offset of the maximum safe front end in the first logic section, and a traveling direction of the train. An offset in a logic section of a coordinate point in the logic section refers to a distance between the coordinate point and a starting point of the logic section in the upward direction, and the first offset and a second offset mentioned later are both determined based on the rule; for example, a point A in FIG. 7 is a point of intersection of 2G and 3G, an offset of the point A in the logic section 2G is a length of the logic section 2G, and an offset of the point A in the logic section 3G is 0. The traveling direction includes the upward direction or the downward direction. For example, the position information may further include a second logic section where a minimum safe rear end of the train is located in the planned train path, and a second offset of the minimum safe rear end in the second logic section. Due to precision of train positioning, a position of a train head is within a range, and the maximum safe front end refers to a maximum point within the range of the position of the train head. The first offset refers to a distance between the maximum safe front end and a starting point of traveling (the starting point in the traveling direction) of the logic section where the maximum safe front end is located. Similarly, the minimum safe rear end refers to a minimum point within a range of a position of a train tail. The second offset refers to a distance between the minimum safe rear end and a starting point of traveling (the starting point in the traveling direction) of the logic section where the minimum safe rear end is located. During the cyclic operation of the train control system, the controller of the train control system receives and records position information sent by the VOBC of the train that has completed registration in the train control system. Therefore, preceding train information within a front preset search length range (a preset search length may be set as required) in the traveling direction of each of trains that has completed registration and runs in the planned train path of the train may be searched for the train.

S30: A train control strategy is performed on the train based on the preceding train information. Determining the preceding train information of the train may be used for optimizing competition efficiency and utilization efficiency of trackside resources in front of the train, and optimizing a traveling speed of the train. In an embodiment, step S30, that is, the performing a train control strategy on the train based on the preceding train information includes the following step. A preset traveling route and/or a traveling speed of the train is adjusted based on the preceding train information of the train. In other words, the train control strategy performed on the train based on the preceding train information may be achieving autonomous planning of a preset traveling route by the train through a train autonomous circumambulation system (TACS), for example, adjusting the preset traveling route of the train to improve efficiency of the autonomous planning of the traveling route by the train. In an embodiment, the train control strategy may also be controlling the traveling speed of the train based on the preceding train information, to reduce unnecessary acceleration and deceleration processes during operation of the train, thereby saving energy, increasing train endurance, improving efficiency of applying to use the trackside resources (such as a turnout and a turnaround track) by the train, improving operating efficiency, increasing a passenger capacity, and reducing line operating costs. It may be understood that when the preceding train information is that no preceding train exists, the train maintains high-speed traveling for a longer time, a passenger experiences a shorter riding time, and the passenger is less likely to feel tired during riding. When the preceding train information is searching for one or more preceding trains, the train needs to perform vehicle-to-vehicle communication with the preceding train, to obtain usage of trackside resources in an area where the preceding train is located, operating route information of the preceding train, and the like. Then through the obtained information, the traveling route is reasonably planned, competition for the trackside resources is optimized, and a probability of a deadlock during the competition for the trackside resources by the train is reduced. In an embodiment, when a new train operating route cannot be planned, a stopping time may be appropriately extended at a platform, or an interval running speed of the train may be reduced, and an interval stopping time may be extended, to reduce intensity of competition for front trackside resources.

It may be understood that, in the case of a crash of the train control system, the present disclosure may further continuously operate normally based on the target combined coordinate system and the preceding train information through another subsystem (for example, the TACS based on vehicle-to-vehicle communication). It may be understood that, if a communication interruption between a train and the train control system is detected, the train control system may calculate, based on latest position information and a running speed reported by the train with the communication interruption, a position area where the train may exist, and set the area as a prohibited area. In this way, before the train with the communication interruption leaves the area, another communication train does not enter the area. Therefore, safety may be ensured. In addition, another communication train may try to get in touch with the train with the communication interruption in a control area by releasing a long-wave radio signal or an on-board flying robot.

In the present disclosure, the train control system (for example, the ATS system) may establish the target combined coordinate system corresponding to the planned train path before the first start of cyclic operation, and then determines the preceding train information of the train directly through the target combined coordinate system during each cyclic operation. Compared with the related art, the coordinate system does not need to be re-established based on a current position of the turnout before each cyclic operation of the train control system, which shortens the operation cycle, and improves the operation efficiency. In addition, in the present disclosure, the preceding train information of each of the trains in the planned train path may be accurately determined based on the physical link relationship between the basic coordinate systems in the target combined coordinate system and the position information of each of the trains. Then the train control strategy is performed on the train based on the preceding train information, and the autonomous planning of the preset traveling route by the train may be performed based on the preceding train information, to improve the efficiency of the autonomous planning of the traveling route by the train. Performing the train control strategy based on the preceding train information may further reduce unnecessary acceleration and deceleration processes during the train operation, thereby saving the energy, increasing the train endurance, improving the efficiency of applying to use the trackside resources (such as a turnout and a turnaround track) by the train, improving the operating efficiency, increasing the passenger capacity, and reducing the line operating costs. Even in the case of the crash of the train control system, the train may further continuously operate normally based on the target combined coordinate system and the preceding train information through another subsystem (for example, the TACS based on vehicle-to-vehicle communication). In the above embodiment, distance ranking does not need to be performed on all trains in the planned train path in the target combined coordinate system (a distance refers to an offset of the train from an origin point or a reference point of the coordinate system). In addition, the above target combined coordinate system is created at a first start of the train control system. Therefore, the coordinate system does not need to be re-established during the cyclic operation of the train control system, which significantly simplifies an amount of calculation, shortens the operation cycle, and reduces a system load. Moreover, the target combined coordinate system in the present disclosure is in a two-dimensional shape, and serves as a better reference compared to a solution in which each coordinate system is used as a one-dimensional line segment (a turnout position in an independent coordinate system is fixed, and therefore each independent coordinate system is a one-dimensional line segment without a bifurcation, but a bifurcation may be formed between the basic coordinate systems in the target combined coordinate system in the present disclosure through the turnout, and therefore is in the two-dimensional shape).

Figure 3:
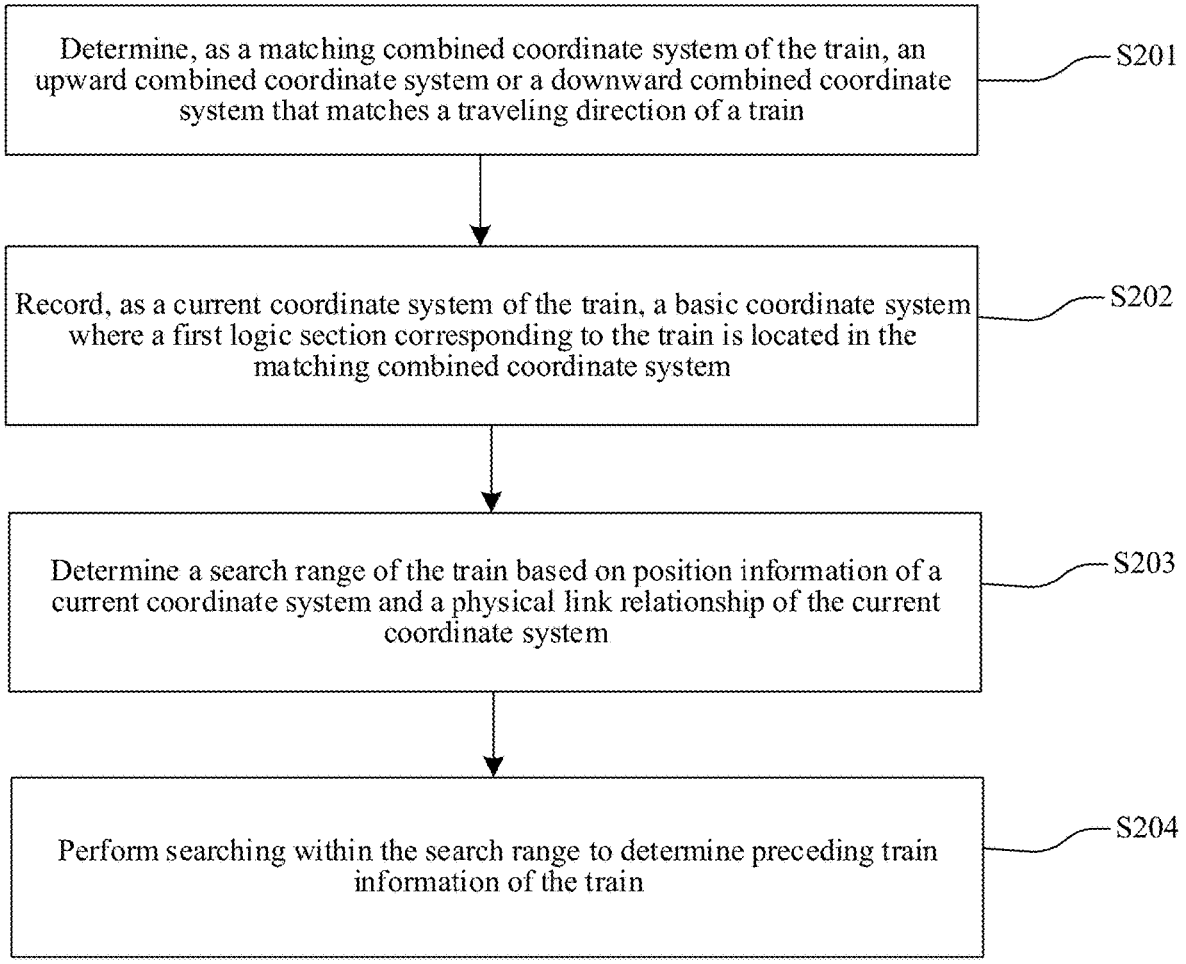
FIG. 3 is a flowchart of step S20 of a train control method based on a combined coordinate system according to an embodiment of the present disclosure.

In an embodiment, as shown in FIG. 3, in step S20, the determining preceding train information of the train based on the position information and the physical link relationship between the basic coordinate systems includes the following steps S201-S204.

S201: The upward combined coordinate system or the downward combined coordinate system matching the traveling direction of the train is determined as a matching combined coordinate system of the train. In other words, when the controller of the train control system determines preceding train information for a train that has successfully registered, a traveling direction of the train needs to be determined, and then it is determined based on the traveling direction in position information of the train whether step S202 is performed in the upward combined coordinate system or the downward combined coordinate system (the upward combined coordinate system or the downward combined coordinate system with the corresponding traveling direction being consistent with the traveling direction of the train is the matching combined coordinate system).

S202: A basic coordinate system where the first logic section corresponding to the train is located in the matching combined coordinate system is recorded as a current coordinate system of the train. In other words, in the matching combined coordinate system, a basic coordinate system where the logic section where the maximum safe front end of the train is located is located is recorded as a current coordinate system of the train.

S203: A search range of the train is determined based on position information of the current coordinate system and a physical link relationship of the current coordinate system. In other words, in the step, the search range may be determined based on a traveling direction, a first offset, the physical link relationship, and the like in the position relationship of the current coordinate system.

S204: Searching is performed within the search range to determine the preceding train information of the train. In other words, within the above search range, the searching is performed based a distance from the train, from the nearest to the furthest, until each piece of the preceding train information is determined, and then the searching is stopped. In this embodiment, the preceding train information may be accurately determined through the position information sent by the train and the physical link relationship between the basic coordinate systems, thereby guiding the execution of the train control strategy.

In an embodiment, the search range includes a first search range. Further, step S203, that is, the determining a search range of the train based on position information of the current coordinate system and a physical link relationship of the current coordinate system includes the following steps.

When a difference between a length of the current coordinate system and the first offset is less than a preset search length, a linking basic coordinate system of the current coordinate system in the traveling direction is determined based on the physical link relationship of the current coordinate system. At least one linking basic coordinate system is provided. In other words, if a distance between a front of the maximum safe front end of the train as the to-be-searched object in a running direction and a terminal boundary point of the current coordinate system in which the train is located (that is, the difference between the length of the current coordinate system and the first offset) is less than the preset search length, after a final search for the current coordinate system is completed, the searching needs to be continuously performed on the linking basic coordinate system linked to the current coordinate system in the current traveling direction.

In the current coordinate system and the linking basic coordinate system, a first search area is determined which extends from the maximum safe front end of the train by the preset search length in the traveling direction, and a logic section that at least partially overlaps the first search area recorded as the first search range of the train. In other words, in this embodiment, an area which extends from the maximum safe front end of the train by the preset search length in the traveling direction of the train is the first search area. It may be understood that the first search range includes two connected logic sections respectively located in the current coordinate system and the linking basic coordinate system. In this embodiment, the above manner of determining the first search range may further ensure accuracy of determining the preceding train information of the train.

Further, in step S204, that is, the performing searching within the search range to determine the preceding train information of the train includes the following steps.

It is determined whether another train exists in the first search range when the first search area does not include the turnout. In other words, in this embodiment, when the first search area does not include the turnout, it indicates that only one linking basic coordinate system is linked to the current coordinate system, and therefore, only one train search route exists. Therefore, determining whether another train exists in the first search range means searching in the logic sections within the first search range in sequence in the traveling direction of the train. Each time a logic section is found, it is determined whether the logic section is within a logic section range where another train that has completed registration in the train control system is currently located. The logic section range is determined through position information of another train received by the train control system. For example, the logic section range may include a first logic section (a logic section where a maximum safe front end of another train is located in the planned train path) and a second logic section (a logic section where a minimum safe rear end of another train is located in the planned train path) corresponding to another train, and a logic section between the first logic section and the second logic section.

When no other trains exists in the first search range, it is determined that a search result for the train is that the train currently has no preceding train. In other words, if the logic section that is found is not within a logic section range where another train is located, it indicates that no preceding train exists within the logic section. In this case, searching is performed on a next logic section in the first search range. If the logic section that is found is within the logic section range where another train is located, it represents/indicates that another train is the preceding train of the train to be searched. It may be understood that, when no preceding train exists in each of the logic sections in the first search range, it is determined that the search result for the train is that the train currently has no preceding train.

It is determined that the search result for the train is that the train currently has a preceding train and the preceding train is at a smallest distance from the maximum safe front end of the train among at least one another train exists in the first search range. In other words, in this embodiment, if the logic sections in the first search range are searched in sequence, and another train exists in at least one of the logic sections, since the first search area in this embodiment does not include the turnout, it indicates that only one linking basic coordinate system is linked to the current coordinate system. Therefore, only one train search route exists. Therefore, another train in a first logic section that is first found is the preceding train of the train. In other words, the preceding train is at the smallest distance from the maximum safe front end of the train among the other trains that are found.

Figure 4:
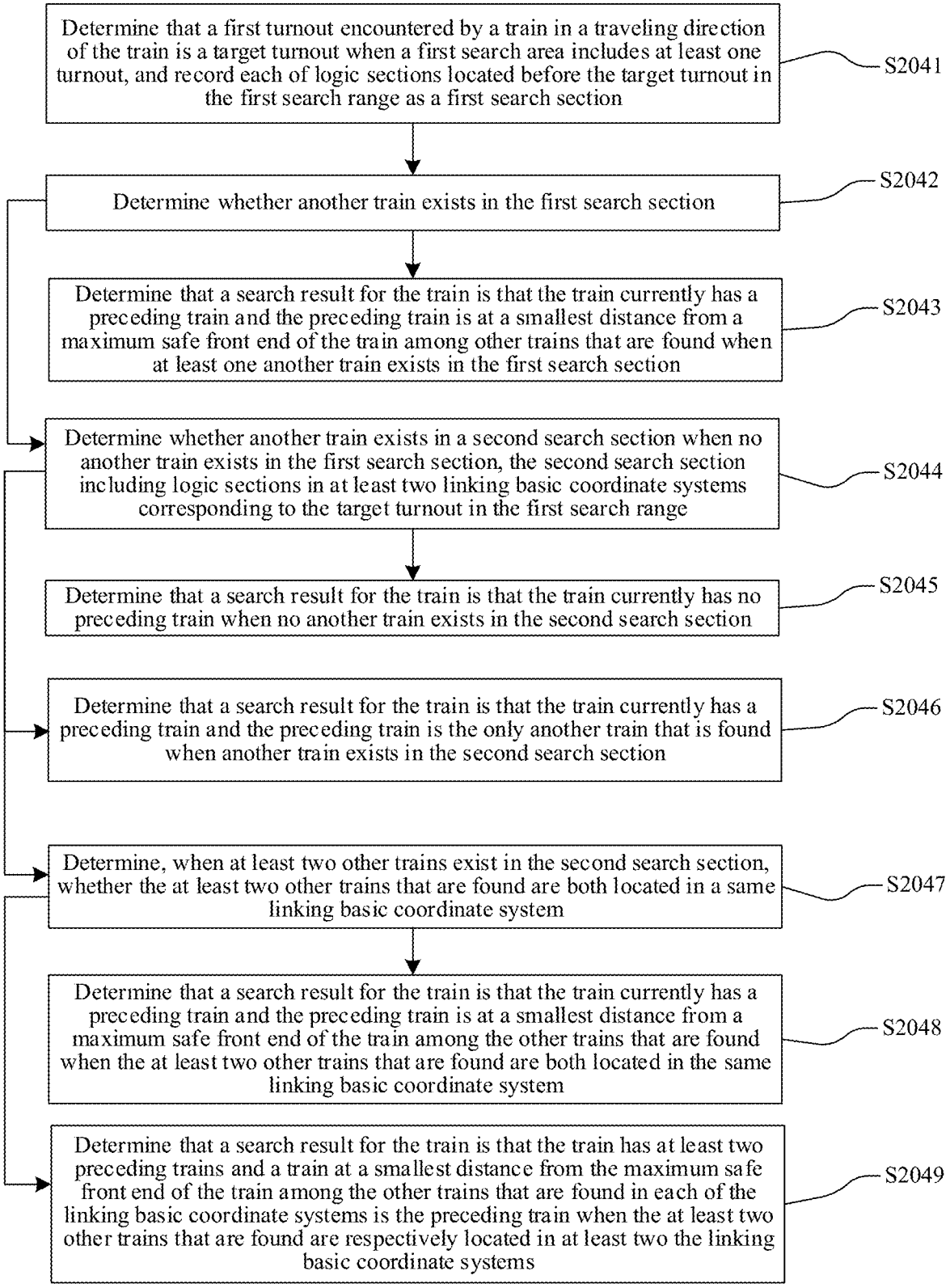
FIG. 4 is a flowchart of step S204 of a train control method based on a combined coordinate system according to an embodiment of the present disclosure.

Further, as shown in FIG. 4, in step S204, that is, the performing searching within the search range to determine the preceding train information of the train includes the following steps S2041-S2043.

S2041: A first turnout encountered by the train in the traveling direction of the train is determined as a target turnout when the first search area includes at least one turnout. Each of logic sections located before the target turnout in the first search range is recorded as a first search section. In other words, in this embodiment, when the first search area includes the turnout, it indicates that multiple linking basic coordinate systems may be linked to the current coordinate system. Therefore, multiple train search routes may exist. In this embodiment, a first turnout that is encountered is determined as the target turnout. If it needs to be determined whether another train exists in the first search range, searching needs to be performed on a common area of the train search routes in the traveling direction of the train (the train search routes overlap in an area before the target turnout, and therefore the area is the common area, and the common area is the first search section).

It may be understood that, in the present disclosure, in an application scenario in which a possibility that multiple turnouts exist in the same search area is relatively low, to reduce an amount of calculation, increase a calculation speed, and reduce a system load, in an embodiment, only the first turnout may be used as the target turnout, another turnout in the first search area is not used as the target turnout for searching, and a basic coordinate system to which another turnout is currently linked in position is directly used as the linking basic coordinate system, and searching is not performed on other basic coordinate systems that are not linked in position. This embodiment facilitates program simplification, reduces a probability of a program error, and facilitates implementation. In another embodiment, to ensure further accuracy of the preceding train information, another turnout located after the first turnout existing in the first search area may also be searched as a next target turnout. For details, reference is made to step S2041 and subsequent steps in this embodiment. Details are not described herein again.

S2042: It is determined whether another train exists in the first search section. It may be understood that searching is performed on the logic sections of the first search section in sequence. Each time a logic section is found, it is determined whether the logic section is within a logic section range where another train that has completed registration in the train control system is currently located.

S2043: It is determined that a search result for the train is that the train currently has a preceding train and the preceding train is at a smallest distance from the maximum safe front end of the train among at least one another train exists in the first search section. In other words, in this embodiment, if the logic sections in the first search section are searched in sequence, and another train exists in at least one of the logic sections, it indicates that the preceding train may have been found in the first search section. Therefore, in this embodiment, the preceding train can be determined without the need to perform searching in each train search route after the target turnout. The preceding train is a train at the smallest distance from the maximum safe front end of the train among the other trains that are found in the first search section.

Further, as shown in FIG. 4, after step S2042, that is, after the determining whether another train exists in the first search section, the method further includes the following steps S2044-S2046.

S2044: It is determined whether another train exists in a second search section when no other trains exists in the first search section. The second search section includes logic sections in at least two linking basic coordinate systems corresponding to the target turnout in the first search range. In other words, when the first search area includes a turnout, the first turnout that is encountered is determined as the target turnout. If the preceding train is not found first in a common area (that is, the first search section) of the train search routes in the traveling direction of the train, the second search section is to be searched. The second search section is an area corresponding to a different train search route after the target turnout. In this case, the logic sections in the at least two linking basic coordinate systems corresponding to the target turnout in the first search range are both second search sections, regardless of whether the above linking basic coordinate systems are linked to the target turnout in position, to improve the accuracy of the preceding train information. It may be understood that searching is performed on the logic sections in the second search section in sequence based on the traveling direction. Each time a logic section is found, it is determined whether the logic section is within a logic section range where another train that has completed registration in the train control system is currently located. Then it is determined accordingly whether another train exists in the second search section.

S2045: It is determined that the search result for the train is that the train currently has no preceding train when no other trains exists in the second search section. In other words, when no other trains exists in both the first search section and the second search section of the first search area, it indicates that the train currently has no preceding train.

S2046: It is determined that the search result for the train is that the train currently has a preceding train and the preceding train is the only another train that is found when another train exists in the second search section. In other words, when no other trains exists in the first search section of the first search area, and the only another train exists in the second search section, it indicates that the only another train that is found is the preceding train.

Further, as shown in FIG. 4, in step S2044, after the determining whether another train exists in a second search section, the method further includes the following steps.

S2047: It is determined, when at least two other trains exist in the second search section, whether the at least two other trains that are found are both located in a same linking basic coordinate system. In other words, when no other trains exists in the first search section of the first search area, and at least two other trains exists in the second search section, it indicates that one or more preceding trains may exist in the other trains that are found, and it further needs to be determined whether the at least two other trains that are found are both located in the same linking basic coordinate system.

S2048: It is determined that the search result for the train is that the train currently has a preceding train and the preceding train is at the smallest distance from the maximum safe front end of the train among the at least two other trains that are found are both located in the same linking basic coordinate system. In other words, when the at least two other trains that are found are both located in the same linking basic coordinate system, it indicates that the other trains exist in only one linking basic coordinate system. In this case, only one preceding train exists, and the preceding train is a train at the smallest distance from the maximum safe front end of the train among the other trains that are found.

S2049: It is determined that the search result for the train is that the train has at least two preceding trains and a train at the smallest distance from the maximum safe front end of the train among the trains found in each of the linking basic coordinate systems is the preceding train, when the at least two other trains that are found are respectively located in the at least two linking basic coordinate systems. In other words, when the at least two other trains that are found are respectively located in the at least two linking basic coordinate systems, it indicates that the other trains exist in the at least two linking basic coordinate systems. In this case, at least two preceding trains exist, and a preceding train exists in each of the linking basic coordinate systems where the other trains exist. The preceding train is a train at the smallest distance from the maximum safe front end of the train among the other trains that are found in each linking basic coordinate system.

In an embodiment, the search range includes a second search range. Further, step S203, that is, the determining a search range of the train based on position information of the current coordinate system and a physical link relationship of the current coordinate system includes the following steps.

When the difference between the length of the current coordinate system and the first offset is greater than or equal to the preset search length, in the current coordinate system, a second search area is determined which extends from the maximum safe front end of the train by the preset search length in the traveling direction, and a logic section that at least partially overlaps the second search area is recorded as the second search range of the train. In other words, if the distance between the front of the maximum safe front end of the train as the to-be-searched object in the running direction and the terminal boundary point of the current coordinate system where the train is located (that is, the difference between the length of the current coordinate system and the first offset) is greater than or equal to the preset search length, it indicates that the preceding train needs to be searched only in the current coordinate system. In this case, the second search range is entirely located in the current coordinate system. In this embodiment, the manner of determining the above second search range may further ensure accuracy of determining the preceding train information of the train, and improve searching efficiency.

Further, in step S204, that is, the performing searching within the search range to determine the preceding train information of the train includes the following steps.

It is determined whether another train exists in the second search range. In other words, since searching needs to be performed only within the second search range of the current coordinate system, the searching is performed on logic sections in the second search range in sequence in the traveling direction of the train. Each time a logic section is found, it is determined whether the logic section is within a logic section range where another train that has completed registration in the train control system is currently located.

When no other trains exists in the second search range, it is determined that a search result for the train is that the train currently has no preceding train. It may be understood that if the logic section that is found is not within a logic section range where another train is located, it indicates that no preceding train exists within the logic section. In this case, searching is performed on a next logic section in the second search range. If the logic section that is found is within the logic section range where another train is located, it represents that another train is the preceding train of the train to be searched. It may be understood that, when no preceding train exists in each of the logic sections in the entire second search range, it is determined that the search result for the train is that the train currently has no preceding train.

When at least one another train exists in the second search range, it is determined that the search result for the train is that the train currently has a preceding train, and the preceding train is at the smallest distance from the maximum safe front end of the train among the other trains that are found. In other words, in this embodiment, if the logic sections in the second search range are searched in sequence, and another train exists in at least one of the logic sections, in this case, another train in a first logic section that is first found is the preceding train of the train. In other words, the preceding train is at the smallest distance from the maximum safe front end of the train among the other trains that are found.

It may be understood that in the above embodiments of the present disclosure, the train (the target train) as the searched object and another train that may be considered as the preceding train both need to be in a normal communication connection state with the controller of the train control system. If communication between the target train as the searched object and the train control system is interrupted, the train control system does not determine preceding train information for the target train. If communication between another train and the train control system is interrupted during determining of the preceding train information for the target train, another train with the communication being interrupted does not appear in the preceding train information determined for the target train by the train control system, but is skipped.

According to the above embodiments of the present disclosure, in an example, FIG. 8 shows a description of the preceding train information. In FIG. 8, preceding train information corresponding to each train (each train is represented by X in FIG. 8, for example, train 1 to train 6 represent different trains) is as follows:

a preceding train of a train 1 is train 2;
a preceding train of a train 2 is train 4;
a preceding train of a train 3 is train 6;
preceding trains of the train 4 are train 5 and train 6;
train 5 has no preceding train; and
preceding trains of the train 6 are train 3 and train 4.

It should be understood that the sequence numbers of the steps in the above embodiments do not mean an execution sequence. The execution sequence of the processes needs to be determined by functions and internal logic of the processes, and should not limit on the implementation process of the embodiments of the present disclosure.

The present disclosure further provides a controller. The controller is configured to perform the above train control method based on a combined coordinate system. An arrangement of the controller of the present disclosure is in one-to-one correspondence with the above train control method based on a combined coordinate system. Details are not described herein again. All or some of modules in the above controller may be implemented by software, hardware, or a combination thereof. The above modules may be built in or independent of a controller of a computer device in a form of hardware, or may be stored in a memory of the computer device in a form of software, so that the controller invokes each of the above modules to perform an operation corresponding to the module.

Figure 9:
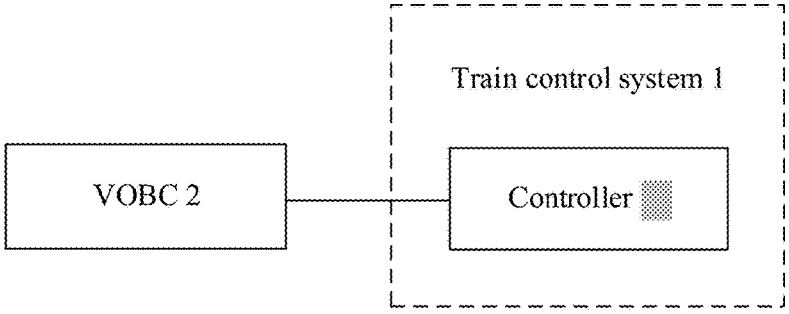
FIG. 9 is a schematic diagram of a module structure of a train control system according to an embodiment of the present disclosure.

As shown in FIG. 9, the present disclosure further provides a train control system 1. The train control system includes a controller communicatively connected to a VOBC 2 of a train. The controller is configured to perform the above train control method based on a combined coordinate system.

In the present disclosure, the train control system 1 (for example, the ATS system) may establish the target combined coordinate system corresponding to the planned train path before the first start of cyclic operation, and then determines the preceding train information of the train directly through the target combined coordinate system during each cyclic operation. Compared with the related art, the coordinate system does not need to be re-established based on a current position of the turnout before each cyclic operation of the train control system, which shortens the operation cycle, and improves the operation efficiency. In addition, in the present disclosure, the preceding train information of each of the trains in the planned train path may be accurately determined based on the physical link relationship between the basic coordinate systems in the target combined coordinate system and the position information of each of the trains. Then the train control strategy is performed on the train based on the preceding train information, and the autonomous planning of the preset traveling route by the train may be performed based on the preceding train information, to improve the efficiency of the autonomous planning of the traveling route by the train. Performing the train control strategy based on the preceding train information may further reduce unnecessary acceleration and deceleration processes during the train operation, thereby saving the energy, increasing the train endurance, improving the efficiency of applying to use the trackside resources (such as a turnout and a turnaround track) by the train, improving the operating efficiency, increasing the passenger capacity, and reducing the line operating costs. Even in the case of a crash of the train control system, the train may further continuously operate normally based on the target combined coordinate system and the preceding train information through another subsystem (for example, the TACS based on vehicle-to-vehicle communication). In the above embodiment, distance ranking does not need to be performed on all trains in the planned train path in the target combined coordinate system (a distance refers to an offset of the train from an origin point or a reference point of the coordinate system). In addition, the above target combined coordinate system is created at a first start of the train control system. Therefore, the coordinate system does not need to be re-established during the cyclic operation of the train control system, which significantly simplifies an amount of calculation, shortens the operation cycle, and reduces a system load. Moreover, the target combined coordinate system in the present disclosure is in a two-dimensional shape, and serves as a better reference compared to a solution in which each coordinate system is used as a one-dimensional line segment.

The above embodiments are merely to describe the technical solutions of the present disclosure, and are not to limit the present disclosure. Although the present disclosure is described in detail with reference to the above embodiments, a person of ordinary skill in the art should understand that modifications may still be made to the technical solutions described in the above embodiments, or equivalent substitutions may be made to some of the technical features. However, these modifications or substitutions do not make the essence of the corresponding technical solution depart from the spirit and scope of the technical solutions of the embodiments of the present disclosure, and all fall within the protection scope of the present disclosure.

What is claimed is:

1. A train control method, based on a combined coordinate system, comprising:

obtaining a target combined coordinate system corresponding to a planned train path, the target combined coordinate system comprising a plurality of basic coordinate systems with boundary logic sections, and each of the basic coordinate systems forming a physical link relationship with another basic coordinate system of the basic coordinate systems through the boundary logic sections;

obtaining position information of a train located in the planned train path sent by the train, and determining preceding train information of a preceding train preceding to the train based on the position information and the physical link relationships between the basic coordinate systems by:

determining an upward combined coordinate system or a downward combined coordinate system matching a traveling direction of the train as a matching combined coordinate system of the train;

recording a basic coordinate system where a first logic section corresponding to the train is located in the matching combined coordinate system as a current coordinate system of the train;

determining a search range of the train based on position information of the current coordinate system and a physical link relationship of the current coordinate system; and searching within the search range to determine the preceding train information of the preceding train; and performing a train control strategy on the train based on the preceding train information.

2. The train control method according to claim 1, wherein each of the basic coordinate systems comprises an upward coordinate system and a downward coordinate system; and before the obtaining a target combined coordinate system corresponding to a planned train path, the method further comprises:

obtaining logic sections in the planned train path, the logic sections comprising the boundary logic sections and ordinary logic sections, wherein the boundary logic sections comprise a bulb line logic section, a turnout logic section, and a terminal logic section, and the ordinary logic sections comprise logic sections other than the boundary logic sections;

determining the upward coordinate system based on upward link relationships of the planned train path, the boundary logic sections, and the ordinary logic sections, and determining the downward coordinate system based on downward link relationships of the planned train path, the boundary logic sections, and the ordinary logic sections;

generating an upward combined coordinate system based on the upward coordinate systems, and generating a downward combined coordinate system based on the downward coordinate systems; and generating the target combined coordinate system based on the upward combined coordinate systems and the downward combined coordinate systems.

3. The train control method according to claim 2, wherein the determining the upward coordinate system based on upward link relationships of the planned train path, the boundary logic sections, and the ordinary logic sections comprises:

determining the upward coordinate system based on upward coordinate system generation requirements, wherein the upward coordinate system generation requirements comprise:

logic sections in the upward coordinate system are connected in sequence based on the upward link relationships;

the upward coordinate system comprises at least one of the boundary logic sections;

each of the ordinary logic sections in the upward coordinate system is located between two of the boundary logic sections; and an upward link relationship of each of the ordinary logic sections in the upward coordinate system is unique.

4. The train control method according to claim 2, wherein the determining the downward coordinate system based on downward link relationships of the planned train path, the boundary logic sections, and the ordinary logic sections comprises:

determining the downward coordinate system based on downward coordinate system generation requirements, wherein the downward coordinate system generation requirements comprise:

logic sections in the downward coordinate system are connected in sequence based on the downward link relationships;

the downward coordinate system comprises at least one of the boundary logic sections;

each of the ordinary logic sections in the downward coordinate system is located between two of the boundary logic sections; and a downward link relationship of each of the ordinary logic sections in the downward coordinate system is unique.

5. The train control method according to claim 2, wherein the boundary logic sections comprise an initial boundary logic section and a terminal boundary logic section, and the physical link relationships comprise an upward physical link relationship; and the generating an upward combined coordinate system based on the upward coordinate systems comprises:

obtaining an upward initial link coordinate system and an upward terminal link coordinate system of the upward coordinate system based on the upward link relationships of the planned train path, wherein the upward initial link coordinate system refers to a previous basic coordinate system of the initial boundary logic section of the upward coordinate system in an upward direction; and the upward terminal link coordinate system refers to a next basic coordinate system of the terminal boundary logic section of the upward coordinate system in the upward direction; and recording the upward initial link coordinate system and the upward terminal link coordinate system as the upward physical link relationship corresponding to the upward coordinate system corresponding to the upward initial link coordinate system and the upward terminal link coordinate system, and generating the upward combined coordinate system based on the upward coordinate systems and the upward physical link relationships corresponding to the upward coordinate systems.

6. The train control method according to claim 2, wherein the boundary logic sections comprise an initial boundary logic section and a terminal boundary logic section; the physical link relationships comprise a downward physical link relationship; and the generating a downward combined coordinate system based on the downward coordinate systems comprises:

obtaining a downward initial link coordinate system and a downward terminal link coordinate system of the downward coordinate system based on the downward link relationships of the planned train path, wherein the downward initial link coordinate system refers to a previous basic coordinate system of the initial boundary logic section of the downward coordinate system in a downward direction; and the downward terminal link coordinate system refers to a next basic coordinate system of the terminal boundary logic section of the downward coordinate system in the downward direction; and recording the downward initial link coordinate system and the downward terminal link coordinate system as the downward physical link relationship corresponding to the downward coordinate system corresponding to the downward initial link coordinate system and the downward terminal link coordinate system, and generating the downward combined coordinate system based on the downward coordinate systems and the downward physical link relationships corresponding to the downward coordinate systems.

7. The train control method according to claim 2, wherein the obtaining position information of a train located in the planned train path sent by the train comprises:

obtaining position information of each of trains located in the planned train path sent by each of the trains through a vehicle on-board controller (VOBC), the position information of each of the trains comprising:

the first logic section where a maximum safe front end of each of the trains is located in the planned train path, and a first offset of the maximum safe front end in the first logic section; and the traveling direction of the train comprising an upward direction or a downward direction.

8. The train control method according to claim 7, wherein the search range comprises a first search range; and the determining a search range of the train based on position information of the current coordinate system and a physical link relationship of the current coordinate system comprises:

determining at least one linking basic coordinate system of the current coordinate system in the traveling direction based on the physical link relationship of the current coordinate system when a difference between a length of the current coordinate system and the first offset is less than a search length; and in the current coordinate system and the at least one linking basic coordinate system, determining a first search area which extends from the maximum safe front end of the train by the search length in the traveling direction, wherein a logic section that at least partially overlaps with the first search area is recorded as the first search range of the train.

9. The train control method according to claim 8, wherein the searching within the search range to determine the preceding train information of the preceding train comprises:

determining a first turnout encountered by the train in the traveling direction of the train as a target turnout when the first search area comprises at least one turnout, and recording logic sections located before the target turnout in the first search range as a first search section;

determining whether one or more other trains exist in the first search section; and in response to determining that one or more other trains exist in the first search section, determining a search result for the train, wherein the search result indicates that the train has a preceding train, and a distance between the preceding train and the maximum safe front end of the train is the shortest among distances between the one or more other trains and the maximum safe front end of the train.

10. The train control method according to claim 9, wherein after the determining whether one or more other trains exist in the first search section, the method further comprises:

in response to determining that no other train exists in the first search section, determining whether one or more other trains exist in a second search section, the second search section comprising logic sections in at least two linking basic coordinate systems corresponding to the target turnout in the first search range;

in response to determining that no other train exists in the second search section, determining the search result for the train, wherein the search result indicates that the train has no preceding train; and in response to determining that one train exists in the second search section, determining the search result for the train, wherein the search result indicates that the one train is a preceding train of the train.

11. The train control method according to claim 10, wherein after the determining whether one or more other trains exist in a second search section, the method further comprises:

when at least two other trains exist in the second search section, determining whether the at least two other trains are located in a same linking basic coordinate system;

in response to determining that the at least two other trains are located in the same linking basic coordinate system, determining the search result for the train, wherein the search result indicates that the train has a preceding train, and a distance between the preceding train and the maximum safe front end of the train is the shortest among distances between the at least two other trains and the maximum safe front end of the train; and when the at least two other trains are respectively located in at least two linking basic coordinate systems, determining the search result for the train, wherein the search result indicates that the train has at least two preceding trains, and a distance between each of the at least two preceding train and the maximum safe front end of the train is the shortest among distances between the other trains and the maximum safe front end of the train in each of the at least two linking basic coordinate systems.

12. The train control method according to claim 8, wherein the searching within the search range to determine the preceding train information of the preceding train comprises:

when the first search area does not comprise a turnout, determining whether another train exists in the first search range;

when no other train exists in the first search range, determining a search result for the train, wherein the search result indicates that the train has no preceding train; and when at least one other train exists in the first search range, determining the search result, wherein the search result indicates that the train has a preceding train, and a distance between the preceding train and the maximum safe front end of the train is the shortest among distances between the at least one other train and the maximum safe front end of the train.

13. The train control method according to claim 7, wherein the search range comprises a second search range; and the determining a search range of the train based on position information of the current coordinate system and a physical link relationship of the current coordinate system comprises:

in the current coordinate system, when a difference between a length of the current coordinate system and the first offset is greater than or equal to a search length, determining a second search area which extends from the maximum safe front end of the train by the search length in the traveling direction, and wherein a logic section that at least partially overlaps with the second search area is recorded as the second search range of the train.

14. The train control method according to claim 13, wherein the searching within the search range to determine the preceding train information of the preceding train comprises:

determining whether another train exists in the second search range;

in response to determining that no other train exists in the second search range, determining a search result for the train, wherein the search result indicates that the train has no preceding train; and in response to determining that at least one other train exists in the second search range, determining the search result for the train, wherein the search result indicates that the train has a preceding train, and a distance between the preceding train and the maximum safe front end of the train is the shortest among distances between the at least one other train and the maximum safe front end of the train.

15. The train control method according to claim 1, wherein the performing a train control strategy on the train based on the preceding train information comprises:

adjusting a traveling route and/or a traveling speed of the train based on the preceding train information.

16. A controller, configured to perform operations based on a combined coordinate system, wherein the operations comprise:

obtaining a target combined coordinate system corresponding to a planned train path, the target combined coordinate system comprising a plurality of basic coordinate systems with boundary logic sections, and each of the basic coordinate systems forming a physical link relationship with another basic coordinate system of the basic coordinate systems through the boundary logic sections;

obtaining position information of a train located in the planned train path sent by the train, and determining preceding train information of a preceding train preceding to the train based on the position information and the physical link relationships between the basic coordinate systems by:

determining an upward combined coordinate system or a downward combined coordinate system matching a traveling direction of the train as a matching combined coordinate system of the train;

recording a basic coordinate system where a first logic section corresponding to the train is located in the matching combined coordinate system as a current coordinate system of the train;

determining a search range of the train based on position information of the current coordinate system and a physical link relationship of the current coordinate system; and searching within the search range to determine the preceding train information of the preceding train; and performing a train control strategy on the train based on the preceding train information.

17. The controller according to claim 16, wherein each of the basic coordinate systems comprises an upward coordinate system and a downward coordinate system; and before the obtaining a target combined coordinate system corresponding to a planned train path, the operations further comprise:

obtaining logic sections in the planned train path, the logic sections comprising the boundary logic sections and ordinary logic sections, wherein the boundary logic sections comprise a bulb line logic section, a turnout logic section, and a terminal logic section, and the ordinary logic sections comprise logic sections other than the boundary logic sections;

determining the upward coordinate system based on upward link relationships of the planned train path, the boundary logic sections, and the ordinary logic sections, and determining the downward coordinate system based on downward link relationships of the planned train path, the boundary logic sections, and the ordinary logic sections;

generating an upward combined coordinate system based on the upward coordinate systems, and generating a downward combined coordinate system based on the downward coordinate systems; and generating the target combined coordinate system based on the upward combined coordinate systems and the downward combined coordinate systems.

18. The controller according to claim 17, wherein the determining the upward coordinate system based on upward link relationships of the planned train path, the boundary logic sections, and the ordinary logic sections comprises:

determining the upward coordinate system based on upward coordinate system generation requirements, wherein the upward coordinate system generation requirements comprise:

logic sections in the upward coordinate system are connected in sequence based on the upward link relationships;

the upward coordinate system comprises at least one of the boundary logic sections;

each of the ordinary logic sections in the upward coordinate system is located between two of the boundary logic sections; and an upward link relationship of each of the ordinary logic sections in the upward coordinate system is unique.

19. A train control system, comprising a controller connected to a vehicle on-board controller (VOBC) of a train, the controller configured to perform operations based on a combined coordinate system, wherein the operations comprise:

obtaining a target combined coordinate system corresponding to a planned train path, the target combined coordinate system comprising a plurality of basic coordinate systems with boundary logic sections, and each of the basic coordinate systems forming a physical link relationship with another basic coordinate system of the basic coordinate systems through the boundary logic sections;

obtaining position information of a train located in the planned train path sent by the train, and determining preceding train information of a preceding train preceding to the train based on the position information and the physical link relationships between the basic coordinate systems by:

determining an upward combined coordinate system or a downward combined coordinate system matching a traveling direction of the train as a matching combined coordinate system of the train;

recording a basic coordinate system where a first logic section corresponding to the train is located in the matching combined coordinate system as a current coordinate system of the train;

determining a search range of the train based on position information of the current coordinate system and a physical link relationship of the current coordinate system; and searching within the search range to determine the preceding train information of the preceding train; and performing a train control strategy on the train based on the preceding train information.

* * * * *